US008672156B2

(12) United States Patent
Martinovic et al.

(10) Patent No.: US 8,672,156 B2
(45) Date of Patent: Mar. 18, 2014

(54) BOTTLE AND CAP

(75) Inventors: Andrej Martinovic, Margaretville, NY (US); Richard J. Zakka, West Palm Beach, FL (US)

(73) Assignee: Cap Craft Corp., New York, NY (US)

( * ) Notice: Subject to any disclaimer, the term of this patent is extended or adjusted under 35 U.S.C. 154(b) by 58 days.

(21) Appl. No.: 13/013,429

(22) Filed: Jan. 25, 2011

(65) Prior Publication Data

US 2012/0187071 A1 Jul. 26, 2012

(51) Int. Cl.
*B65D 51/28* (2006.01)

(52) U.S. Cl.
USPC ..... 215/253; 215/227

(58) Field of Classification Search
USPC ..... 215/DIG. 8, 227, 251–253; 206/219, 206/221, 222; 220/521, 254.8
See application file for complete search history.

(56) References Cited

U.S. PATENT DOCUMENTS

| | | | | |
|---|---|---|---|---|
| 4,024,952 | A | 5/1977 | Leitz | |
| 4,502,604 | A | 3/1985 | Martus | |
| 5,211,973 | A | 5/1993 | Nohren, Jr. | |
| 5,465,835 | A | 11/1995 | Schumacher et al. | |
| 5,950,819 | A | 9/1999 | Sellars | |
| 5,967,309 | A | 10/1999 | Robles-Gonzalez et al. | |
| 6,170,654 | B1 | 1/2001 | Gartner et al. | |
| 6,209,718 | B1 | 4/2001 | Mollstam et al. | |
| 6,221,416 | B1 | 4/2001 | Nohren, Jr. | |
| 6,644,471 | B1 | 11/2003 | Anderson | |
| 6,705,490 | B1 | 3/2004 | Lizerbram et al. | |
| 6,705,491 | B1 | 3/2004 | Lizerbram et al. | |
| 6,772,910 | B1 | 8/2004 | Coory | |
| 6,820,740 | B1 | 11/2004 | Spector | |
| 6,886,686 | B2 | 5/2005 | Anderson | |
| 6,935,493 | B2 | 8/2005 | Cho | |
| 6,945,393 | B2 | 9/2005 | Cho | |
| 6,959,841 | B2 | 11/2005 | Vlodek | |
| 7,032,745 | B2 | 4/2006 | Saulle | |
| 7,070,046 | B2 | 7/2006 | Cho | |
| 7,210,575 | B2 | 5/2007 | Oswald | |
| 7,347,322 | B2 | 3/2008 | Cho | |
| 7,503,453 | B2 * | 3/2009 | Cronin et al. | 206/221 |
| 7,537,112 | B2 | 5/2009 | Balazik | |
| 7,546,919 | B2 * | 6/2009 | Lee | 206/221 |

(Continued)

FOREIGN PATENT DOCUMENTS

| | | |
|---|---|---|
| KR | 10-2006-0015685 | 2/2006 |
| KR | 2006015685 A | 2/2006 |

(Continued)

OTHER PUBLICATIONS

KR_10-2007-0086328_translation.pdf.*

(Continued)

*Primary Examiner* — Mickey Yu
*Assistant Examiner* — Allan Stevens
(74) *Attorney, Agent, or Firm* — Goodwin Procter LLP

(57) ABSTRACT

The embodiments described herein disclose a bottle and cap. The cap seals the bottle and thereby defines a compartment within the bottle for storing liquid or other material. The cap also includes an internal compartment for storing a liquid or other material in a sealed manner. The cap is designed to readily allow for sterilization during manufacturing, maintaining proper sealing of the compartments, dispensing material from one compartment into the other and providing a tamper-resistant closure.

16 Claims, 17 Drawing Sheets

(56) References Cited

U.S. PATENT DOCUMENTS

| | | | | |
|---|---|---|---|---|
| 7,562,770 | B1 | 7/2009 | Roque | |
| 7,568,576 | B2 | 8/2009 | Sweeney, Jr. et al. | |
| 7,588,142 | B1 | 9/2009 | Bush | |
| 7,874,420 | B2 * | 1/2011 | Coon | 206/219 |
| 2003/0222102 | A1 | 12/2003 | Cho | |
| 2004/0050868 | A1 | 3/2004 | Lizerbram et al. | |
| 2004/0200742 | A1 | 10/2004 | Cho | |
| 2005/0040052 | A1 | 2/2005 | Dixon | |
| 2006/0108135 | A1 | 5/2006 | Cho | |
| 2006/0118435 | A1 | 6/2006 | Cronin et al. | |
| 2006/0254936 | A1 | 11/2006 | Corbitt et al. | |
| 2007/0023300 | A1 | 2/2007 | Spector et al. | |
| 2007/0051689 | A1 | 3/2007 | Anderson | |
| 2007/0074979 | A1 | 4/2007 | Cho | |
| 2007/0193893 | A1 | 8/2007 | Lee et al. | |
| 2007/0193894 | A1 | 8/2007 | Macken et al. | |
| 2007/0251910 | A1 | 11/2007 | Mastin | |
| 2008/0023349 | A1 | 1/2008 | Balazik | |
| 2008/0054001 | A1 | 3/2008 | Roth et al. | |
| 2009/0139882 | A1 | 6/2009 | DeJonge | |
| 2009/0194533 | A1 | 8/2009 | Lizerbram et al. | |
| 2010/0012193 | A1 | 1/2010 | Anson et al. | |
| 2010/0044254 | A1 | 2/2010 | Romeo | |
| 2011/0226770 | A1 | 9/2011 | Tiesberger | |

FOREIGN PATENT DOCUMENTS

| | | | |
|---|---|---|---|
| KR | 10-2007-0086328 | * | 8/2007 |
| KR | 10-2008-0040532 | | 5/2008 |
| KR | 2008040532 A | | 5/2008 |
| WO | WO 2006/046725 A1 | | 5/2006 |
| WO | WO 2009/020294 A1 | | 2/2009 |
| WO | WO 2010/040366 A1 | | 4/2010 |

OTHER PUBLICATIONS

KR_10-2007-0086328.pdf.*
International Search Report dated Sep. 17, 2012.
Written Opinion of the International Searching Authority dated Sep. 24, 2012.
International Preliminary Report on Patentability dated Feb. 19, 2013.

* cited by examiner

BOTTLE AND CAP

FIELD AND BACKGROUND

The present invention relates generally to a bottle and cap defining separate compartments for containing liquids or other materials. Manipulation of the cap allows the compartments to communicate so that the liquid or other materials can be mixed.

DESCRIPTION OF THE PRIOR ART

Most bottles in the market today have one compartment for storing a liquid or other material. Some bottles have separate compartments for containing liquids or other materials. U.S. Pat. Nos. 6,170,654, 6,209,718 and 6,644,471 and U.S. Patent Application Publication Nos. 2007/0074979 and 2007/0193893 are representative of such bottles. However, these bottles suffer from significant drawbacks such as presenting challenges to sterilization during manufacturing, maintaining the proper sealing of the bottle during use, dispensing of the material from one compartment into the other compartment and providing a tamper-resistant closure.

SUMMARY

The embodiments described herein disclose a bottle and cap. The cap seals the bottle and thereby defines a compartment within the bottle for storing liquid or other material. The cap also includes an internal compartment for storing a liquid or other material in a sealed manner.

The cap is comprised of two pieces—a bottle cap and a payload cap. The bottle cap contacts and attaches to the bottle. The payload cap contacts and attaches to the bottle cap. Externally, the payload cap resembles a conventional twist-off bottle cap.

The bottle cap, payload cap and bottle cooperate to define two compartments—one compartment within the bottle and another within the cap. Specifically, the payload cap includes a cylindrical chamber that cooperates with the bottle cap to form a payload cavity in which liquid or other material can be contained separate from the contents of the bottle. The payload cap and bottle cap are in threaded engagement. Manipulation of the payload cap causes the compartments to communicate allowing the liquid or other material in the compartments to be mixed. The bottle cap has supports and a payload cavity closure. The supports may be biased against the payload cap to prevent the contents of the payload cavity from being inadvertently released into the bottle (for example due to atmospheric temperature and pressure fluctuation).

Liquid or other material may be stored in the compartment within the cap to protect it from deterioration, e.g. by sunlight, or contamination, until the cap is manipulated to mix the liquids or materials in the compartments. The payload cavity can be used to maintain the potency of any material contained therein.

The cap has multiple seals to permit sealing of the bottle and payload cavity and discharge of the liquid or other material in the payload cavity into the bottle. There are seals that prevent liquid or other material from escaping/entering from/into the payload cavity. There are seals to prevent liquid or other material from escaping/entering from/into the bottle. The seals are designed such that the contents of the payload cavity can be maintained under positive pressure over atmospheric pressure, the contents of the bottle can be maintained under a negative (vacuum) pressure compared to atmospheric pressure, and the contents of the payload cavity can be mixed with the contents of the bottle without any leakage outside of the bottle or cap.

The payload cap has tamper-evidence attachments to the bottle cap, and the bottle cap has tamper resistant attachment to the bottle. The bottle cap is in threaded engagement within the bottle. Once screwed to the bottle, the bottle cap cannot be removed from the bottle without physical destroying the bottle cap. The payload cap and bottle cap are not reusable, thus guarding against tampering or misuse of the payload cap, bottle cap and the bottle in any combination.

The contents of the payload cavity may be stored under pressure and, when the payload cap is loosened, the seal between the payload cap and the bottle is broken and the contents of the payload cavity are forced into the bottle by combination of differential pressure between the payload cavity and the bottle cavity. In addition or alternatively, the contents of the bottle may be stored under a slight vacuum so that when the payload cap is loosened the contents of the payload cavity are sucked down into the bottle. Any residual payload on the bottom of the bottle cap is dispersed into the bottle 16 by mixing of the bottle content before removal of the payload cap. The seal on the bottle cap opens after the seal on the bottom of payload cavity to aid in the discharge of the payload by differential pressure between the payload cavity and the bottle.

After mixing the contents of the payload cavity and bottle, the payload cap can be removed to dispense the mixture now contained with the bottle. The payload cap also can be re-affixed to the bottle cap piece to preserve the content of the bottle for later use.

The construction of the cap allows for ready sterilization during manufacturing. The surfaces of the payload cap and the bottle cap are manufactured sterile, then are sterilized after filling the payload cavity during cap assembly, sterilized during bottle capping, and sterilized after bottle and cap assembly.

Materials used for the construction of the payload cap and bottle cap minimizes air permeability into the payload cavity and protects the material in the payload cavity from the influence of Ultra Violet light. Further, the materials are optimized to have minimum surface tension, so as not to attract the payload after the contents of the payload cavity are discharged into the bottle. The material of construction is plastic alloy based on polyethylene containing other additives (i.e. UV blocker, surface tension reducing additive, and color).

BRIEF DESCRIPTION OF THE DRAWINGS

FIG. 2A is a perspective view; FIG. 2B is a side view; FIG. 2C is a cross-sectional view along lines A-A from FIG. 2B; FIG. 2D is a detail of a seal used on the consumer access port—payload cap; FIG. 2E is a detail of female threads on the payload cap and the payload cap tamper evidence ring; FIG. 2F is a cross-sectional view along lines B-B from FIG. 2B showing the torque transfer ribbing on the payload cap.

FIG. 3A is a perspective view; FIG. 3B is a side view; FIG. 3C is a cross-sectional view along lines C-C from FIG. 2B; FIG. 3D is a detail of the male threads on the bottle cap and tamper evidence flange for the payload cap; FIG. 3E is a detail of a bottle latch on the bottle cap; FIG. 3F is a cross-sectional view along lines D-D from FIG. 2B showing the torque transfer ribbing on the bottle cap. FIG. 3G is an alternative cross-sectional view along line C-C from FIG. 2B showing detail 28 and detail 76.

FIG. 5A shows the three sets of seals on the assembled bottle and cap. FIG. 5B shows a detail of a set of seals used on the cap.

DETAILED DESCRIPTION

Figure 1:
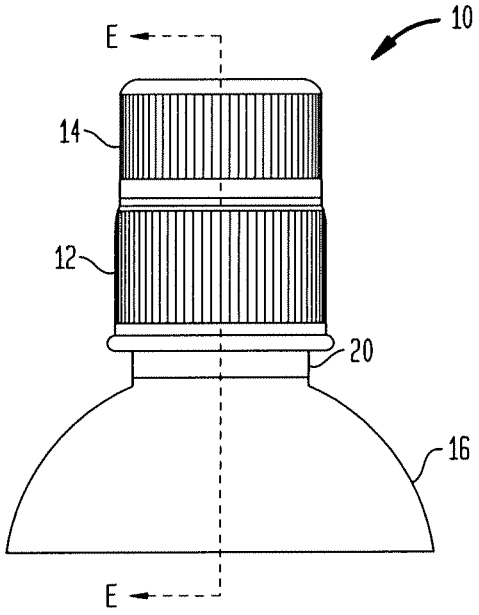
FIG. 1 depicts an exemplary embodiment of a bottle and cap.
Figure 2A:
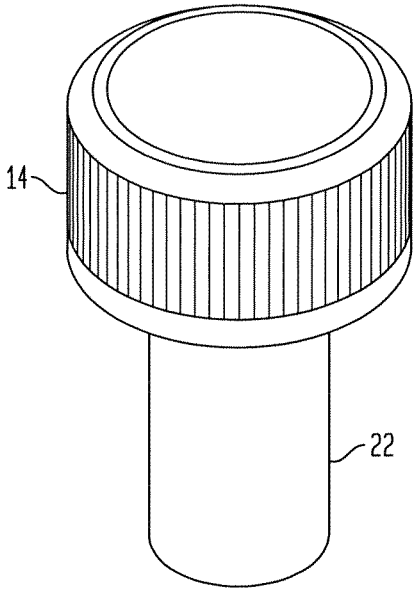
FIGS. 2A to 2F depict various views of an exemplary embodiment of payload cap.
Figure 2B:
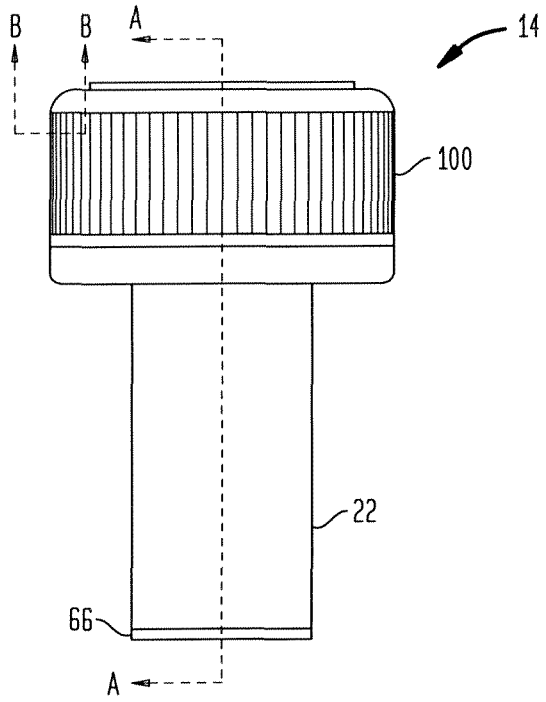
Figure 2C:
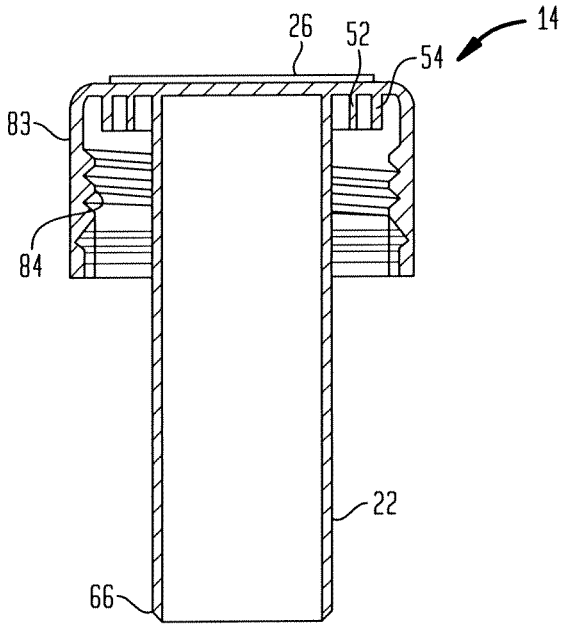
Figure 2D:
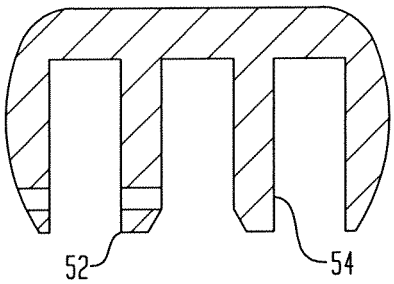
Figure 2E:
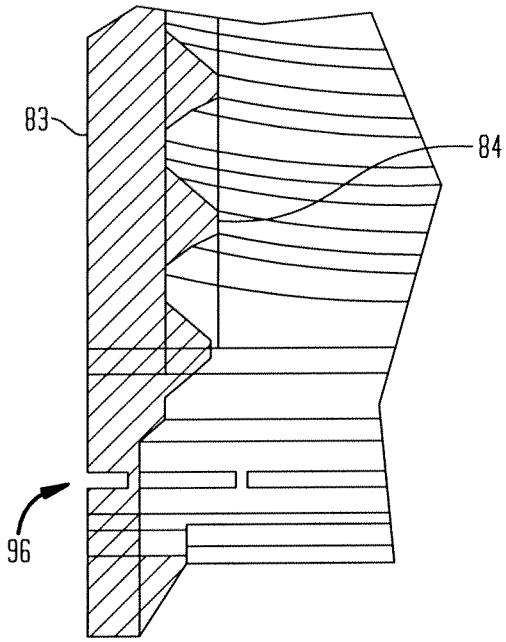
Figure 2F:
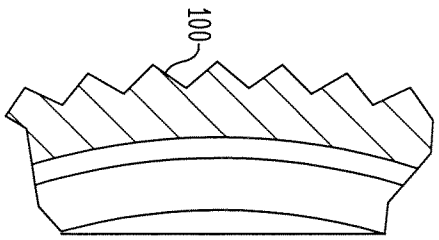
Figure 3A:
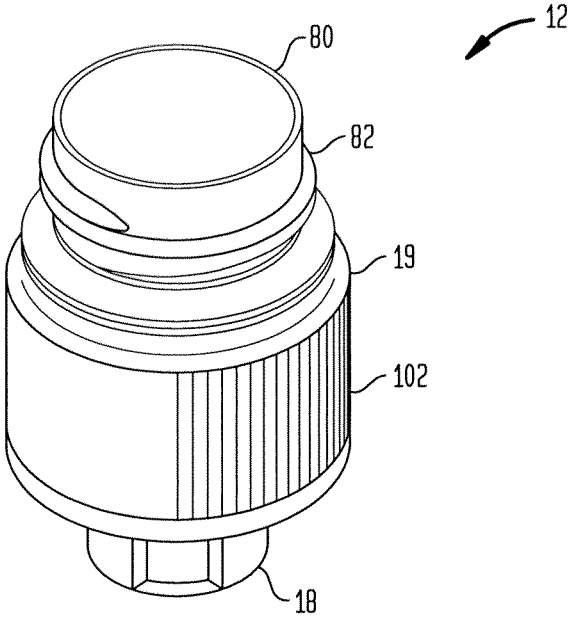
FIGS. 3A to 3G depict various views of an exemplary embodiment of bottle cap.
Figure 3B:
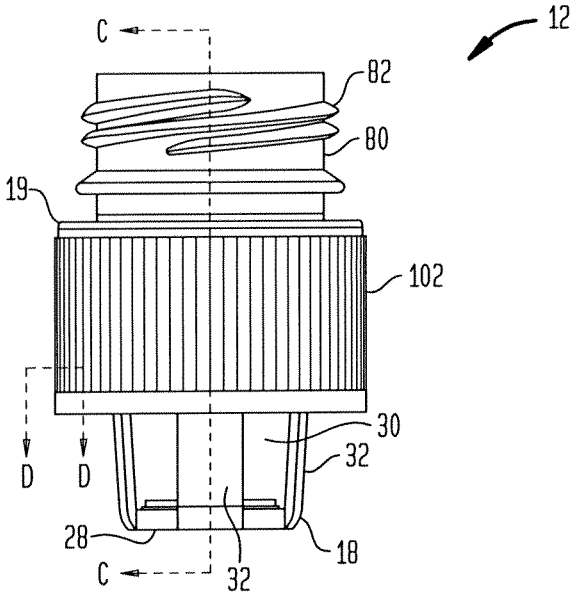
Figure 3C:
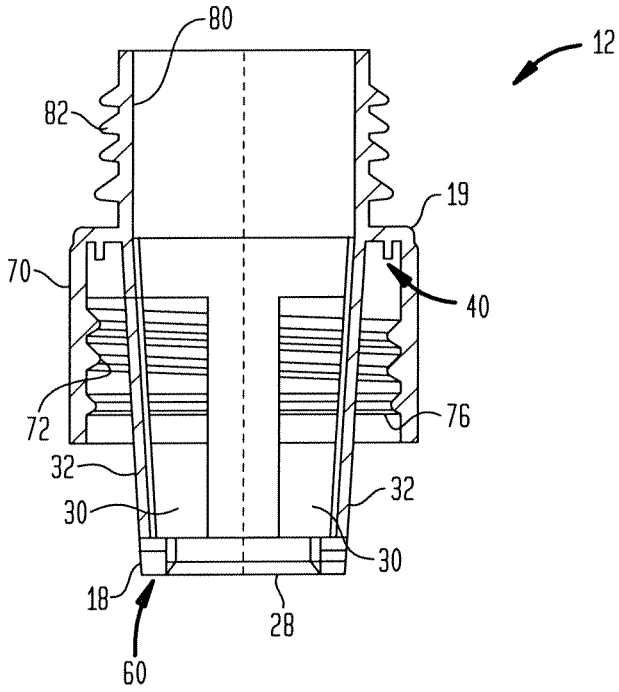
Figure 3D:
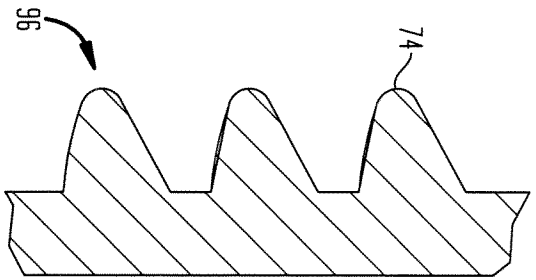
Figure 3E:
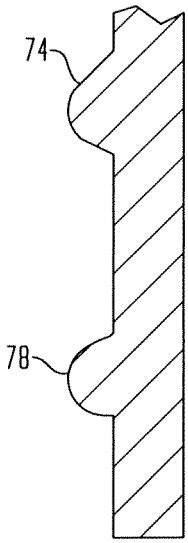
Figure 3F:
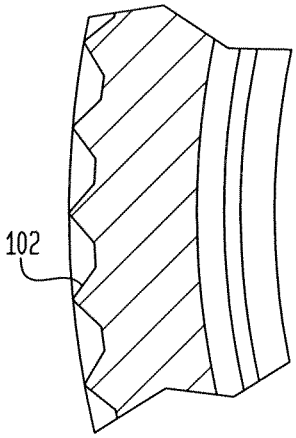
Figure 3G:
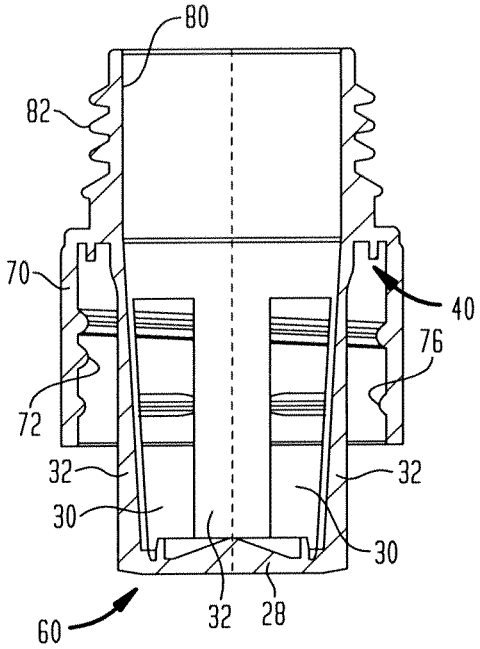
Figure 4:
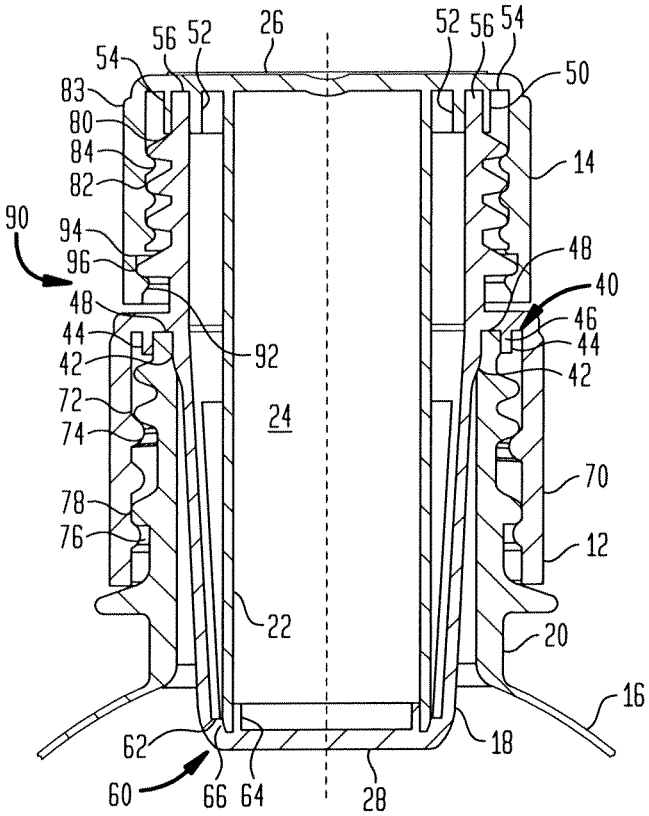
FIG. 4 depicts a cross-sectional view of a bottle and cap along lines E-E from FIG. 1.

The foregoing and other features and advantages of the bottle and cap will be apparent from the following, more particular description of a preferred embodiment, as illustrated in the accompanying drawings wherein like reference numbers generally indicate identical, functionally similar, and/or structurally similar elements. While specific exemplary embodiments are discussed, it should be understood that this is done for illustrative purposes only. A person skilled in the relevant art will recognize that other components and configurations can be used without departing from the scope of the invention as defined by the claims.

Structure of Embodiment of Cap

The cap 10 is comprised of two pieces, a bottle cap 12 and a payload cap 14.

Bottle cap 12 contacts bottle 16. It has a lower portion 18 that fits within the inner circumference of the neck 20 of the bottle 16 on which cap 10 is used. The payload cap 14 has a lower cylindrical portion 22. The lower cylindrical portion 22 of the payload cap fits within the inner circumference of bottle cap 12.

The payload cap 14 and bottle cap 12 cooperate to define a payload cavity 24. Specifically, the payload cavity 24 is formed by the cylindrical wall of the lower portion 22 of the payload cap 14 in conjunction with the upper wall 26 of the payload cap 14 and the lower wall 28 of the bottle cap 12 forming a payload cavity closure.

The lower portion 18 of the bottle cap 12 that is inserted down the neck 20 of the bottle 16 has openings 30 that serve as discharge ports for the liquid or other material stored in the payload cavity 24 when the payload cap 14 piece is manipulated. The openings 30 are defined between support legs 32 connecting the upper portion 19 of bottle cap 12 and lower wall of the bottle cap 28. The bottom 28 of the bottle cap 12 can be formed as a cone or pyramidal to provide structural rigidity for the bottom 28, supports seals 64 and 66, minimize any residual payload in the bottom 28, and aid in dispersing the payload into the bottle 16.

There are three sets of seals between the bottle 16, bottle cap 12 and payload cap 14. The set of seals between bottle cap 12 and bottle 16 is the bottle seal 40, the set of seal between the bottle cap 12 and payload cap cavity 14 is the payload cavity seal 60, and the set of seals between the bottle cap 12 and payload cap 14 is the consumer access port seal 50.

Figure 5A:
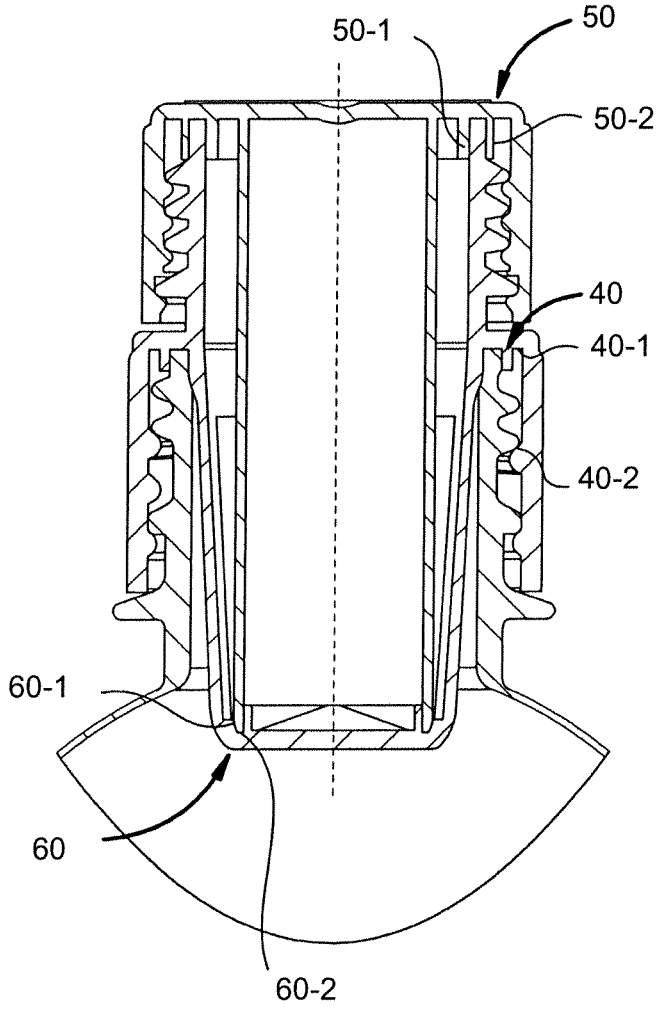
FIGS. 5A and 5B depict seals used with the cap.

FIG. 5A depicts bottle seal 40, consumer access port seal 50, and payload cavity seal 60. Each of the three seals comprises a pressure seal and a vacuum seal. Bottle seal 40 comprises pressure seal 40-2 and vacuum seal 40-1. Consumer access port seal 50 comprises pressure seal 50-1 and vacuum seal 50-2. Payload cavity seal 60 comprises pressure seal 60-1 and vacuum seal 60-2.

Figure 5B:
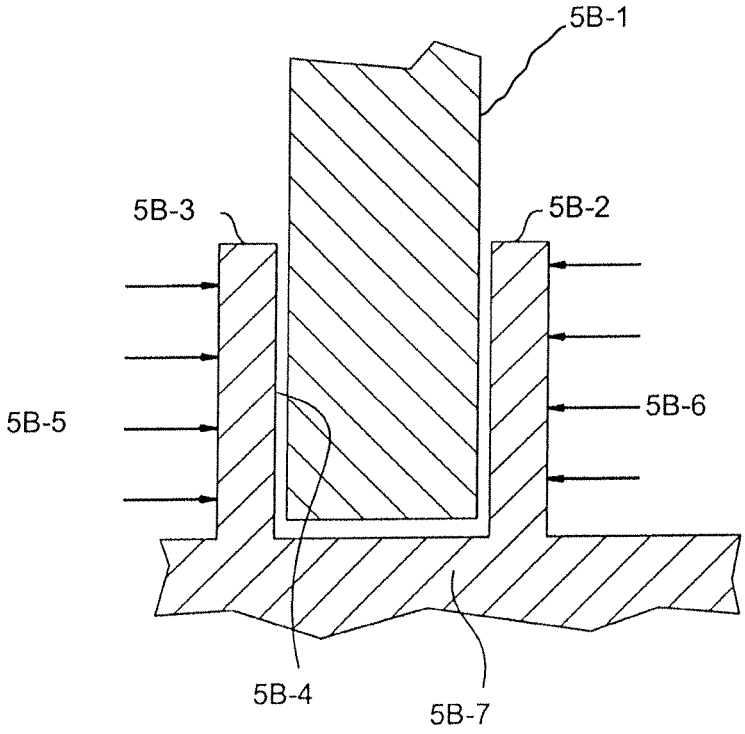

Each set of seals is comprised of inner cylinder and outer cylinder as shown in FIG. 5B. The two cylinders are forming a channel having a "U-shaped" cross-section (5B-7). Into the middle of the U, a wall of a tube (5B-1) is inserted. This unique arrangement provides seal in both directions of pressure gradient. If the pressure on the right side of the U (5B-6) is higher than the pressure on the left side (5B-5), then the right side of the U is compressed against the inner wall of the tube proportional to the pressure gradient and forms a pressure seal (5B-2). The sealing pressure increases with the pressure gradient thus maintaining the seal up to the structural strength of the components. When the pressure gradient is reversed, the fight left side of the U will be compressed against the outside of the tube and forms a vacuum seal (5B-3). In absence of pressure gradient there is interference compression (right side of the U) and interference expansion (left side of the U) that provides seal (5B-4). This unique seal arrangement was develop to provide definite seal under broad atmospheric conditions of atmospheric pressure and temperature fluctuations. The embodiment of these sets of seals is only one of many embodiments that can be implemented on these principles by those skilled in this art.

The bottle seal (first seal) is comprised of seal 40, between the bottle 16 and the bottle cap 12, comprises a cylindrical portion 42 mating with the inner surface of the neck 20 of the bottle 16 and a cylindrical protuberance 44 mating with the outer surface of the neck 20 of the bottle. Cylindrical portion 42, cylindrical protuberance 44 and portion 46 of the bottle cap 12 envelop the upper most portions 48 of the neck of the bottle 20 forming a seal between bottle cap 12 and bottle 16. The combination of the two seals 42 and 44 provides a deterministic seal of pressure gradient in both directions (between the inside of the bottle 16 and the atmospheric pressure outside the bottle and cap 10). This is to prevent contamination of the contents of the bottle 16 with outside air during the product shelf life, and escape of product from the bottle.

The consumer access port seal (second seal) is comprised of seal 50, between the bottle cap 12 and payload cap 14, comprises two cylindrical protuberances 52 and 54 extending from the upper wall 26 of the payload cap 12. Protuberances 52 and 54 envelop the upper most portions 56 of the bottle cap 12 forming a seal between the bottle cap 12 and payload cap 14. The combination of the two seals 52 and 54 provides a deterministic seal of pressure gradient in both directions (between the inside of the bottle 16 and the atmospheric pressure outside the bottle and cap 10). This is to prevent contamination of the content of the bottle 16 with outside air during the product shelf life.

The payload cap seal (third seal) is comprised of seal 60, between the bottle cap 12 and payload cap 14 forming the payload cavity closure, comprises a largely cylindrical portion 62 of the bottle cap 12 mating with a largely cylindrical portion 64 of the payload cap 14. The largely cylindrical portion of the payload cap 14 has an end 66. Portion 64 is formed as a protuberance from the lower wall of the bottle cap 28. The portion 62 and 64 envelop the end 66 of the payload cap 14 forming a seal between the bottle cap and payload cap and forming a closure for the payload cavity 24. The combination of the two seals 62 and 64 provides a deterministic seal of pressure gradient in both directions (between the payload cavity 24 and the inside of the bottle 16). This is to prevent contamination of the content of the bottle with payload during the product shelf life.

The bottle seal 40 (first seal) can be formed integrally with the bottle cap 12. The consumer access port seal 50 (second seal) can be formed integrally with the payload cap 14. The payload cavity seal 60 (third seal) can be fowled integrally with the bottle cap 12.

Bottle cap 12 has a cylindrical portion 70 with threads 72 on the inner surface of cylindrical portion 70. Neck 20 of bottle 16 has threads 74 on its outer surface. Threads 72 and 74 are complimentary such that bottle cap 12 can be screwed on and off bottle 16 until latched by 76. When the threads of bottle cap 12 and bottle 16 are engaged, cylindrical portion 70 of bottle cap 12 is disposed externally of neck 20 of bottle 16 around the threaded neck 20 of bottle 16. Bottle cap 12 also has a ridge 76 along the inner circumference of the cylindrical portion 70 at the lower edge of the cylindrical portion. Ridge 76 engages a corresponding ridge 78 on neck 20 of bottle 16. Ridge 78 is below threads 74 on neck 20 of bottle 16. Ridges 76 and 78 cooperate to lock bottle cap 12 onto bottle 16. Bottle cap 12 is secured to bottle 16 by placing bottle cap 12 onto the neck 20 of bottle 16, twisting bottle cap 12 in a clockwise direction (right handed thread is used in this example) so that threads 72 and 74 engage pulling bottle cap 12 down over neck 20 of bottle 16 until ridges 76 and 78 engage. Once ridges 76 and 78 are fully engaged the ridges work as a latch between the bottle cap 12 and bottle 16 such that bottle cap 12 cannot be removed from bottle 16 without physically destroying the bottle cap 12.

Bottle cap 12 has a second cylindrical portion 80 with threads 82 on the outer surface of cylindrical portion 80. Payload cap 14 has a cylindrical portion 83 having threads 84 on its inner surface. Threads 82 and 84 are complimentary such that payload cap 14 can be screwed on and off bottle cap 12. When the threads of payload cap 14 and bottle cap 12 are engaged, cylindrical portion 83 of payload cap 14 is disposed externally of cylindrical portion 80 of the bottle cap 12. Payload cap 14 also has a tamper evident seal 90. Ridges 92 and 94 cooperate to participate in the tamper evidence seal. Ridge 94 is formed on the lower edge of the outer circumference of cylindrical portion 80 of bottle cap 12 and ridge 92 is formed on the inner circumference of cylindrical portion 83 of payload cap 14. Ridge 94 is below threads 82 on bottle cap 12. Ridges 92 and 94 cooperate to lock payload cap 14 onto bottle cap 12. The bottle cap 12 is secured to payload cap 14 by placing bottle cap 12 cylindrical portion 80 onto payload cap 14, twisting bottle cap 12, while holding the payload cap 14 stationary (the stationary and rotating components can be reversed), in a clockwise direction (right handed thread is used in this example) so that threads 82 and 84 engage pulling cylindrical portion 80 of bottle cap 12 down into payload cap 14 until ridges 92 and 94 engage. Once ridges 92 and 94 are fully engaged, payload cap 14 and bottle cap 12 are secured forming the cap with a tamper proof seal.

Near the lower edge of cylindrical portion 83 of payload cap 14 are perforations 96. Twisting payload cap 14 in a counter clockwise direction will break the tamper evident seal at perforations 96 and allow removal of payload cap 14 from bottle cap 12. The payload cap 14 can be replaced by positioning the payload cap 14 on cylindrical portion 80 of the bottle cap and twisting the payload cap 14 clockwise so threads 82 and 84 engage and pulls the payload cap 14 down over the cylindrical portion 80 of the bottle cap 12. Of course, once the tamper evident seal 90 is broken at the perforations 96, it is not restored upon reattaching payload cap 14 to bottle cap 12.

Ribs 100 on payload cap 14 and ribs 102 on bottle cap 12 facility gripping and twisting of the payload cap 14 and bottle cap 12. Ribs 100 and 102 on the payload cap 14 and bottle cap 12 are different and are specifically designed to be able to carry the torque needed to lock the payload cap 14 and bottle cap 12 together. The ribs 102 on the bottle cap are designed to carry the torque needed to lock the bottle cap 12 to the bottle. Additionally, the ribs 100 on the payload cap 14 are optimized for consumer unscrewing the payload cap 14 by hand. The customary 14 foot-inch torque for human fingers was used to design the ribbing 100. This gives the consumer familiar feeling of opening a convention water bottle when opening the cap.

Filling and Sterilization of Embodiment of Bottle and Cap

For caps used with sterile materials (e.g. liquids for human consumption), sterilization of the cap, the cap filing during assembly with payload, and the cap and bottle assembly is an integrated process with several steps performed simultaneously. The bottle cap and the payload cap components are sterilized during the manufacturing in injection molding process by heating the material (plastic) above 110° C. for a sufficient duration to assure a sterile product. This process produces sterile components. The sterility of the components is assured during storage via inspections.

During cap filling and assembly operations, the payload cavity 24 is injected with liquid or other material by turning the payload cap 14 upside down and pouring the material into cavity 24. In this approach gravitation force is used to keep the liquid in the cavity. Alternatively, the payload cap can be span and centrifugal force can be used to keep the liquid in the cavity. Then bottle cap 12 is attached to the payload cap 14 while the payload cavity is facing upward. The bottle cap 12 is placed over the payload cap and one of the caps is twisted clockwise until threads 82 and 84 engage. Continued twisting of the caps results in the sealing of payload cavity 24 by sealing the payload cap 14 to the bottle cap 12. The lower wall 28 of the bottle cap 12 is sealed against end 66 of payload cap 14 to define the payload cavity 24. In this manner, lower wall 28 forms a closure for the payload cavity 24. Continued twisting of the caps results in the locking of the tamper evidence seal via ridges 92 and 94.

The payload cavity 24 is filled with not compressible liquid or solids and air. The payload cap 14, bottle cap 12 and the corresponding seals 50 and 60 are arranged in a way that the payload cavity 24 is sealed before the payload cap 14 and bottle cap 12 are fully screwed together. End 66 of payload cap 12 contacts seal 60 on closure 28 before threads 72 and 74 are fully engaged. As the payload cap 14 bottled cap 12 are screwed together bringing threads 72 and 74 to a fully engaged position, the air inside the payload cavity is compressed placing the inside of the payload cavity 24 under positive pressure. Immediately after filling the cap 10 is inverted to have the payload cavity 24 faced down. The cap 10 is sterilized by spraying ozonated water (or other sterilizing compounds) at high pressure on the top and into the annulus formed between the payload cap and the bottle cap. Subsequently the entire cap is dried with sterile air. The primary purpose of this sterilization step is to remove any contamination that may be contacted from the cap filing and assembly apparatus. The cap 10 then can be stored inside sterile environment (polypropylene bag) for the duration of shelf life or until assembled onto bottle.

The bottle 16 is sterilized by rinsing and then by filling of the bottle with ozonated water. The bottle 16 is filled with ozonated water (product water) up to the top of the bottle. The excess water will be used to do the second stage sterilization of the cap 10 be forcing the water around the bottom of the cap while locking the cap onto the bottle.

Then the fully assembled cap 10 and is attached to bottle 16 previously filled with ozonated water or other liquid. This is done by securing the bottle cap 12 to bottle 16. The bottle cap 12 is placed over bottle 16 and is twisted clockwise until threads 74 and 75 engage. Continued twisting of the bottle cap 12 results in the locking of the bottle cap 12 to bottle 16 via ridges 76 and 78.

The vacuum in the bottle 16 is created during the cap attachment process. The bottle 16 is first filled with liquid to the top of the bottle. The cap 10 is placed on the bottle and securely hold in position, but not attached. Next, the bottle 16 is squeezed forcing desired amount of liquid out of the bottle around the cap 10. This expelled ozonated water sterilizes the surfaces of the cap that can be wetted by the product water. The purpose of this sterilization is to remove any contaminants that may have been contacted from air while the cap was stored in sterile environment. After the desired amount of liquid has been expelled from the bottle 16, the cap 10 is permanently attached to the bottle. The amount of liquid expelled from the bottle controls the vacuum that is created in the inside of the bottle. The bottle is specifically designed to be able to resist collapse due to the vacuum.

To ensure that all the internal surfaces of the cap 10 have been sterilized, the complete bottle 16 and cap 10 assembly is inverted immediately after locking together for specific time to allow the ozonated water inside the bottle 16 to make contact with all the inside surfaces of the cap 10. The two piece construction of the cap 10 facilitates sterilization of the bottle 16 and cap 10 in this manner.

Non-limiting examples of beverage mix that can be used with the bottle and cap include the following: a dry milk material, a tea mix, a coffee mix, a flavored beverage mix, a baby formula, a dry lemonade, a flavor, a juice mix, a powder drink mix, an electrolyte drink mix, an energy drink mix, a protein drink mix, and/or a sweetened beverage mix.

Non-limiting examples of a supplement that can be used with the bottle and cap include the following: a protein supplement, a flavoring, a non-sugar or other sweetener, a diabetic product, a nutrient, an electrolyte mixture, an energy drink, a dietary supplement, and/or a vitamin supplement.

Non-limiting examples of a dehydrate food that can be used with the bottle and cap include the following: a dehydrated liquid remnant, dehydrated alcohol, a cake mix, a pudding mix, a pancake mix, a gelatin mix, and/or a soup mix.

Non-limiting examples of a medicine that can be used with the bottle and cap include the following: a pharmaceutical, an ingestible, an antibiotic, a prescription drug, an over the counter drug, and/or a laxative.

Use of Embodiment of Bottle and Cap

Once bottle 16 and cap 10 are filled with liquid or other material, the cap 10 can be manipulated to allow mixing of the contents of the payload cavity 24 and the bottle 16. When payload cap 14 is twisted counter clockwise the payload cap will move away from bottle cap 12. As the payload cap 14 moves away from bottle cap 12, the lower end 66 of payload cap 14 will no longer be sealed against cylindrical portion 62 and protuberance 64, breaking the seal 60 between the payload cap 12 and the bottle cap 14. As the payload cap 14 is further twisted it will continue to move away from bottle cap 14 such that payload cavity 24 is in communication with bottle 16 through openings 30 formed between lower wall 28 and support legs 32 of the bottle cap 12 and the lower portion 22 of the payload cap 14. Liquid or other material stored within the payload cavity 14 is released into the bottle 16 such that the contents of the payload cavity 24 and bottle 16 are mixed.

The releasing of the liquid or other material in the payload cavity 24 into bottle 16 is facilitated by maintaining the contents of payload cavity 24 under pressure and/or maintaining the contents of the bottle 16 under a vacuum. Specifically, the contents of payload cavity 24 can be stored under pressure and when the payload cap 14 is loosened breaking seal 60 between the payload cap 14 and the bottle cap 12, the contents of the payload cavity 24 are forced into the bottle 16 by the pressure in the payload cavity 24 being released into bottle 16. In addition or alternatively, the contents of the bottle may be stored under a slight vacuum so that when the payload cap 14 is loosened breaking seal 60 the contents of the payload cavity 24 are sucked into the bottle by the vacuum in bottle 16. The breaking of seal 40 coincides with the breaking of the payload cap tamper evidence ring 90, when this occurs the consumer access port seal 50 is closed and the content of the bottle and payload cavity can be mixed by shaking the bottle by the consumer, without spilling any content from the bottle or cap.

When payload cap 14 is further loosened such that seal 50 is broken, any material remaining in the payload cavity 24 is forced into bottle 16 by in rushing air.

Continued twisting of the payload cap 14 after the contents of the payload cavity 24 have been discharged into the bottle 16 results in the payload cap 14 being removed from bottle cap 12. Removing the payload cap 14 from bottle cap 12 will allow dispensing of the contents of bottle 16 (the mixture of the contents of the payload cavity 24 and the original contents of the bottle 16). Thereafter, the contents of the bottle 16 can be stored by reattaching the payload cap 14 to bottle cap 12. Reattaching the payload cap 14 to bottle cap 12 will result in resealing of seal 50 between the payload cap 14 and the bottle cap 16 maintaining the contents of the bottle.

We claim:

1. A cap comprising:

a payload cap and a bottle cap, the payload cap and bottle cap defining a payload cavity;

wherein said payload cap comprises a tube having an inner surface, an outer surface, and an end, and wherein said bottle cap comprises an upper portion, a lower wall, and support legs, wherein said support legs connect said upper portion to said lower wall;

wherein said lower wall comprises a channel having a substantially U-shaped cross-section;

wherein said channel comprises an outermost cylinder, an innermost cylinder, and a bottom; and wherein said channel extends along the entire perimeter of said lower wall;

wherein said innermost cylinder comprises an upward extending flange; wherein said upward extending flange comprises an inner surface and an outer surface; and wherein the bottle cap is capable of forming a first seal with a bottle;

a second seal disposed between the bottle cap and the payload cap;

the first and second seal cooperating to prevent the contents of a bottle to which the cap is attached from escaping;

a third seal disposed between the bottle cap and the payload cap and sealing the payload cavity; wherein the third seal is formed by inserting the end of the tube of the payload cap into the channel on the lower wall of the bottle cap such that the outer surface of the upward extending flange contacts the inner surface of the tube of the payload cap, and the inner surface of the upward extending flange contacts the contents of the payload cavity;

wherein manipulation of the payload cap breaks the third seal such that the payload cavity is in communication with the bottle while maintaining the first and second seals.

2. The cap of claim 1 further comprising:

the payload cap and bottle cap are in threaded engagement;

twisting of the payload cap in relation to the bottle cap in the clockwise direction causes the threads to engage;

the payload cavity is sealed when the threads on the payload cap and bottle cap are engaged;

twisting the payload cap in a counter clockwise direction causes the threads to disengage;

the payload cap can be removed from the bottle cap when the threads are fully disengaged.

3. The cap of claim 1 wherein said cap is capable of maintaining the payload cavity under pressure;

the pressure in the payload cavity facilitating the discharge of contents of the payload cavity into the bottle when the third seal is broken.

4. The cap of claim 1 wherein said cap is capable of maintaining a vacuum in the bottle;

the vacuum in the bottle facilitating the discharge of contents of the payload cavity into the bottle when the second and third seals are broken.

5. The cap of claim 3 wherein said cap is capable of maintaining a vacuum in the bottle;

the vacuum in the bottle facilitating the discharge of contents of the payload cavity into the bottle when the second and third seals are broken.

6. The cap of claim 1 wherein the first, second and third seals are each comprised of two elements providing pressure seals in two directions.

7. The cap of claim 1 wherein the bottle cap and payload cap are formed of materials to which the contents of the payload cavity will not adhere thereby facilitating the discharge of contents of the payload cavity into the bottle.

8. The cap of claim 5 wherein the bottle cap and payload cap are formed of materials to which the contents of the payload cavity will not adhere thereby facilitating the discharge of contents of the payload cavity into the bottle.

9. The cap of claim 2 wherein the bottle cap is capable of threaded engagement with a bottle to which the cap is to be attached such that twisting of the bottle cap in relation to the bottle in the clockwise direction causes the threads to engage whereby the bottle is sealed when the threads on the bottle cap and bottle are engaged;

the bottle cap having a ridge that mates with a corresponding ridge on the bottle;

the ridges on the bottle cap and bottle cooperate to lock the bottle cap to the bottle when the threads are fully engaged.

10. The cap of claim 9 further comprising:

ribs on the bottle cap optimized to facilitate twisting of the bottle cap in relation to the bottle to lock the bottle cap to the bottle;

ribs on the payload cap optimized to facilitate twisting of the payload cap in relation to the bottle cap to seal the payload cap to the bottle cap.

11. The cap of claim 2 further comprising:

the payload cap has a lower end;

the bottle cap having a closure;

the third seal being disposed on the closure;

the end of the payload cap contacts the third seal before the threads are fully engaged;

twisting of the payload cap until the threads are fully engaged creates pressure in the payload cavity.

12. The cap of claim 1 wherein said lower wall of said bottle cap has a substantially conical surface.

13. The cap of claim 1 wherein said lower wall of said bottle cap has a substantially pyramidal surface.

14. The cap of claim 2 wherein breaking of the third seal coincides with the breaking of a payload cap tamper evidence ring.

15. The cap of claim 14, wherein said cap remains sealed to outside when the tamper evidence ring is broken, but the payload cap was not removed yet, facilitating the mixing of the content of the bottle without spilling any of the content outside of the cap or bottle.

16. A process for sterilizing the cap of claim 1 and a bottle to which the cap is to be attached, said process comprising:

filling the payload cavity with the desired contents, sealing the payload cavity, spraying the assembled cap with ozonated water;

rinsing the bottle to which the cap is to be attached with ozonated water followed by filling said bottle with ozonated water, placing the assembled cap on said bottle without engaging the threads, squeezing said bottle such that ozonated water is expelled from said bottle and contacts the assembled cap.

* * * * *